US005971798A

United States Patent [19]

Hoppe

[11] Patent Number: 5,971,798

[45] Date of Patent: Oct. 26, 1999

[54] QUICK RELEASE POWER CONNECTOR

[75] Inventor: Richard J. Hoppe, Rockford, Ill.

[73] Assignee: Sundstrand Corporation, Rockford, Ill.

[21] Appl. No.: 08/991,376

[22] Filed: Dec. 16, 1997

[51] Int. Cl.[6] ..... H01R 3/00

[52] U.S. Cl. ..... 439/488; 439/737

[58] Field of Search ..... 439/246, 247, 439/488, 489, 737, 910

[56] References Cited

U.S. PATENT DOCUMENTS

| | | | |
|---|---|---|---|
| 1,755,166 | 4/1930 | Cannon . | |
| 3,611,247 | 10/1971 | Adams et al. . | |
| 4,265,503 | 5/1981 | Baur . | |
| 4,850,896 | 7/1989 | Smith et al. | 439/489 |
| 4,915,648 | 4/1990 | Takase et al. | 439/490 |
| 5,562,486 | 10/1996 | Saijo et al. | 439/489 |
| 5,601,450 | 2/1997 | Nabeshima et al. | 439/489 |

FOREIGN PATENT DOCUMENTS 0 635 699 A1 1/1995 European Pat. Off. .

*Primary Examiner*—Khiem Nguyen
*Attorney, Agent, or Firm*—Leydig, Voit & Mayer Ltd.

[57] ABSTRACT

An electrical power connection module adapted to indicate when a weld between a pin and a socket has occurred. The present invention provides a multiple pin plug wherein each pin mounted in the plug is attached thereto using a spring means. The biasing means is adapted to maintain the pin in a first position if a weld has not occurred, and a second position if a weld has occurred to thereby provide the user with a visual indication of the welded pin. Therefore, rather than requiring that an entire line replaceable unit be removed and replaced at substantial cost and delay, the present invention allows the user to quickly determine which pin has become welded, and to quickly disconnect the welded pin from the plug for removal of the plug and then subsequent removal of the welded pin.

18 Claims, 5 Drawing Sheets

QUICK RELEASE POWER CONNECTOR

TECHNICAL FIELD

The present invention generally relates to electrical connectors, and more particularly relates to electrical connectors adapted to provide a user with an indication as to when a weld has occurred between connectors.

BACKGROUND

Modern aircraft include a large number of electrically powered systems which need to be supplied with power through conductors in the form of various types of cabling, wires, or the like. Early prior art systems used individual connectors dedicated to certain components to connect components together, or to a source of power. In aerospace electrical equipment systems, most of the electrical power connections were of the threaded terminal type to which the aircraft cable was connected with lugs at the ends of the wire cable. Electrical connections of signal level power were typically not made with such threaded terminal type connectors, but rather were made with circular connectors. Regardless of whether threaded terminal type or circular type connectors are employed, individual dedicated lines were used to connect each component.

However, as the size and scope of modern aircraft have increased, so have the electrical wiring demands within the aircraft. More recent cabling has therefore attempted to combine a number of lines into a single cable and provide a multiple-pin plug at the end of the cable for connection to a multiple-receptacle socket. Such systems allow for easier installation and repair over systems employing individual cables, and impose less severe weight and space penalties onboard an aircraft. U.S. Pat. Nos. 5,562,486 and 5,601,450 are indicative of prior art systems wherein multiple lines are combined into a single connector.

While multiple pin plugs and sockets do alleviate some of the problems associated with individual wires for each individual component onboard the aircraft, the multiple pin plugs and sockets can be difficult to disconnect under certain circumstances, thus resulting in costly downtime for the aircraft. With specific reference to the scope of the present application, one difficulty arises when a pin welds to the socket within which it is received. Even though all the other pins may be free from the other sockets, one welded pin can prevent the multiple pin plug from being separated from the multiple opening socket. The problem can be accentuated if multiple pins and socket receptacles become welded together.

Moreover, not only does the welded pin and socket prevent the multiple pin plug from being disconnected, but the operator is not provided with any means of determining the source of the difficulty, or even the exact pin and socket which are welded together. This therefore requires that the entire cabling system along with the multiple pin plug and socket, referred to as a Line Replaceable Unit (LRU), be replaced at substantial cost and downtime for the aircraft. Given the aircraft industry and its ever-increasing efficiency requirements, such cost and downtime are unacceptable. The industry demands that a means be provided for quickly determining the source of the weld, and quickly alleviating the problem to return the aircraft to service.

While prior art devices have provided various types of electrical connectors to indicate to the user the state of the connection, none have specifically addressed the problem of determining when a weld has occurred, or which connection has actually become welded together. For example, U.S. Pat. No. 4,915,648 discloses an electrical connector which provides the user with an indication as to when the connectors are connected and locked in place. However, no means is provided to indicate when connectors have welded together.

SUMMARY

It is therefore a primary aim of the present invention to provide an electrical power connector which is adapted to allow for quick disconnection even when individual pins and sockets have become welded together.

It is an objective of the present invention to provide the user of the electrical power connector with a visual indication of when a pin and socket combination have become welded together, as well as the particular pin and socket combination which have become welded together.

It is another objective of the present invention to provide an electrical power connector which increases the speed with which the damaged cabling can be replaced, while at the same time minimizing the cost of such replacement.

It is a still further objective of the present invention to provide a method by which a user can quickly determine which pin and socket combination, or combinations, have become welded together.

In accordance with these aims and objectives, it is a feature of the present invention to provide an electrical power connector which includes a plurality of sockets adapted to receive a plurality of pins in mating orientation, wherein a spring means surrounds each of the pins and which is adapted to compress if the plug is attempted to be pulled from the socket and a particular pin is actually welded to the socket.

It is another feature of the present invention to provide a cover for the connector through which a user can visually determine which spring means has compressed, and thus which pin and socket combination have become welded together. Upon determining which pin and socket combination have become welded together, the user can then remove the problematic pin to thereby eliminate the costly and time-consuming process of replacing the entire connector and cabling system.

It is a further feature of the present invention to provide a power connector including a multiple pin plug and multiple receptacle socket wherein each pin is connected to the plug using a nut and washer fastened to a threaded end of the pin, and a spring is interposed between the washer and the plug. Therefore, when the plug is pulled from the socket, the spring will compress and the pin will be displaced into the plug if a weld exists between a welded pin and socket to thereby provide the user with a visual indication of which pin and socket combination is welded together.

It is a still further feature of the present invention to provide a method for detecting when an electrical pin and socket combination have become welded together including the steps of pulling on a multiple pin plug matingly connected to a multiple receptacle socket, wherein the multiple pin plug includes a plurality of pins connected thereto using a spring means, and viewing the spring means as the plug is attempted to be pulled from the socket and detecting a weld if the spring means compresses during the pulling step.

It is yet another feature of the present invention to provide a multiple pin plug and multiple receptacle socket combination, wherein each receptacle is threadably attached to the socket using a nut threaded to the receptacle, and the receptacle is removable from the socket in the event a weld occurs between a pin and a receptacle to thereby increase the speed with which the unit can be replaced and thus the aircraft can be returned to service.

These and other aims, objectives, and features of the present invention will be most completely and beneficially understood as explained in the following detailed description when read and comprehended in conjunction with the accompanying drawings. It is important to understand that while the preferred embodiment of the present invention is directed toward a multiple pin plug and multiple receptacle socket electrical connection module for use on aircraft, the inventive features of the present invention can be employed with equal efficacy in any non-aircraft application which requires a means for determining which connection has welded together and a means for quickly replacing such a welded connection.

Figure 1:
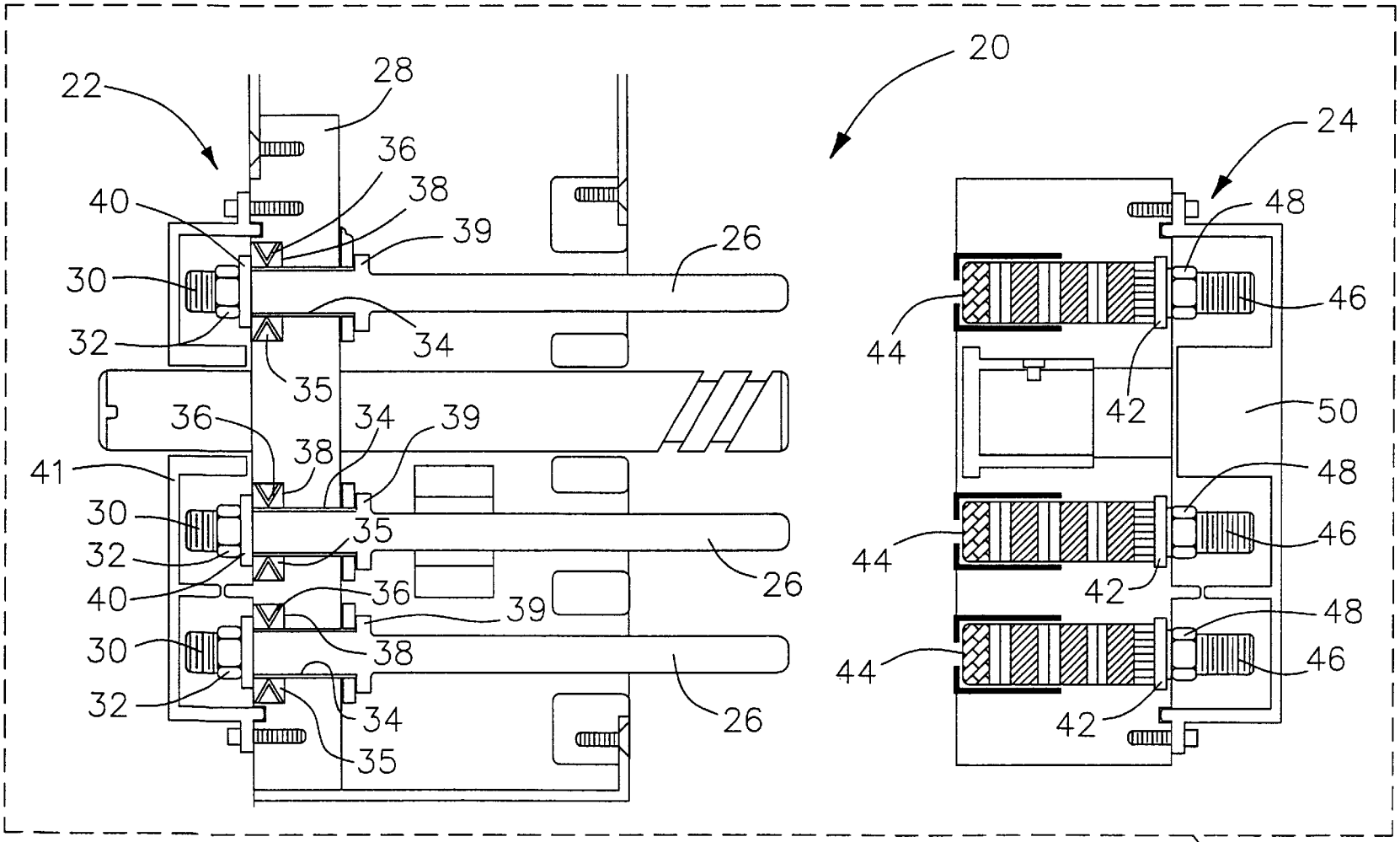
FIG. 1 is a sectional view of the preferred embodiment of the present invention in disconnected orientation.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DESCRIPTION OF THE INVENTION

Referring now to FIG. 1, the preferred embodiment of the present invention is generally designated as electrical connection module 20. While it is envisioned that the predominate use of the preferred embodiment of the present invention will be onboard aircraft 21 to enable line replaceable units to be quickly removed and replaced, it is to be understood that the present invention, in alternative embodiments, could be employed with equal efficacy in conjunction with a wide variety of other applications wherein complex wiring systems are used, and means for quickly detecting when a weld at an electrical connection has occurred would be beneficial to, among other things, reduce the downtime of the machine with which the wiring is associated.

As shown in FIG. 1, electrical connection module 20 includes a plug 22 adapted to be matingly received by a socket 24. Plug 22, as depicted in its preferred embodiment, includes three (3) individual pins 26 which can be used to conduct electricity from socket 24 to bus bar 28. While the preferred embodiment is depicted as plug 22 having only three (3) pins 26, alternative embodiments can include plugs having a differing number of pins depending on the particular electrical requirements of the given application.

Figure 2:
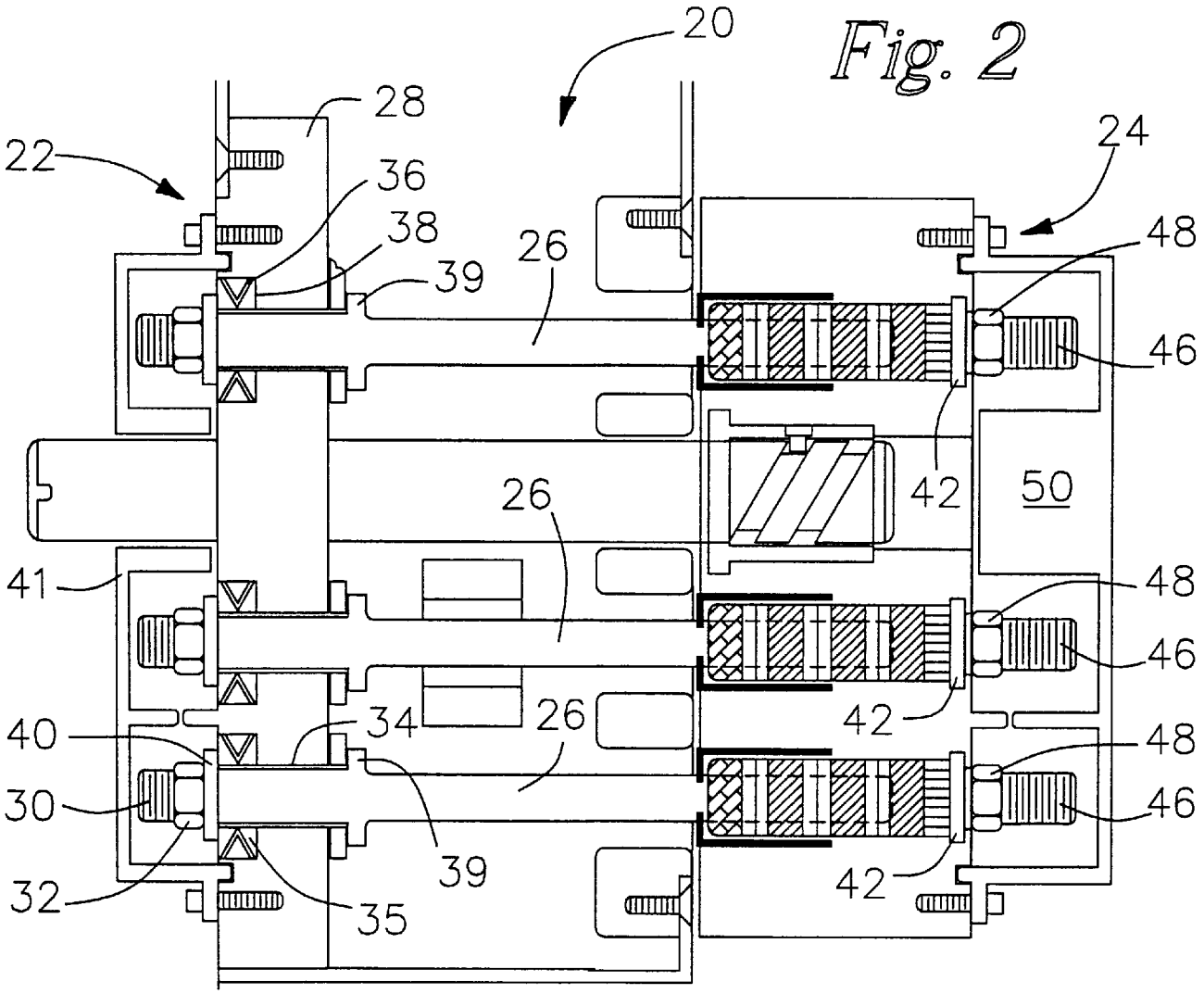
FIG. 2 is a sectional view of the preferred embodiment of the present invention in connected orientation.
Figure 3:
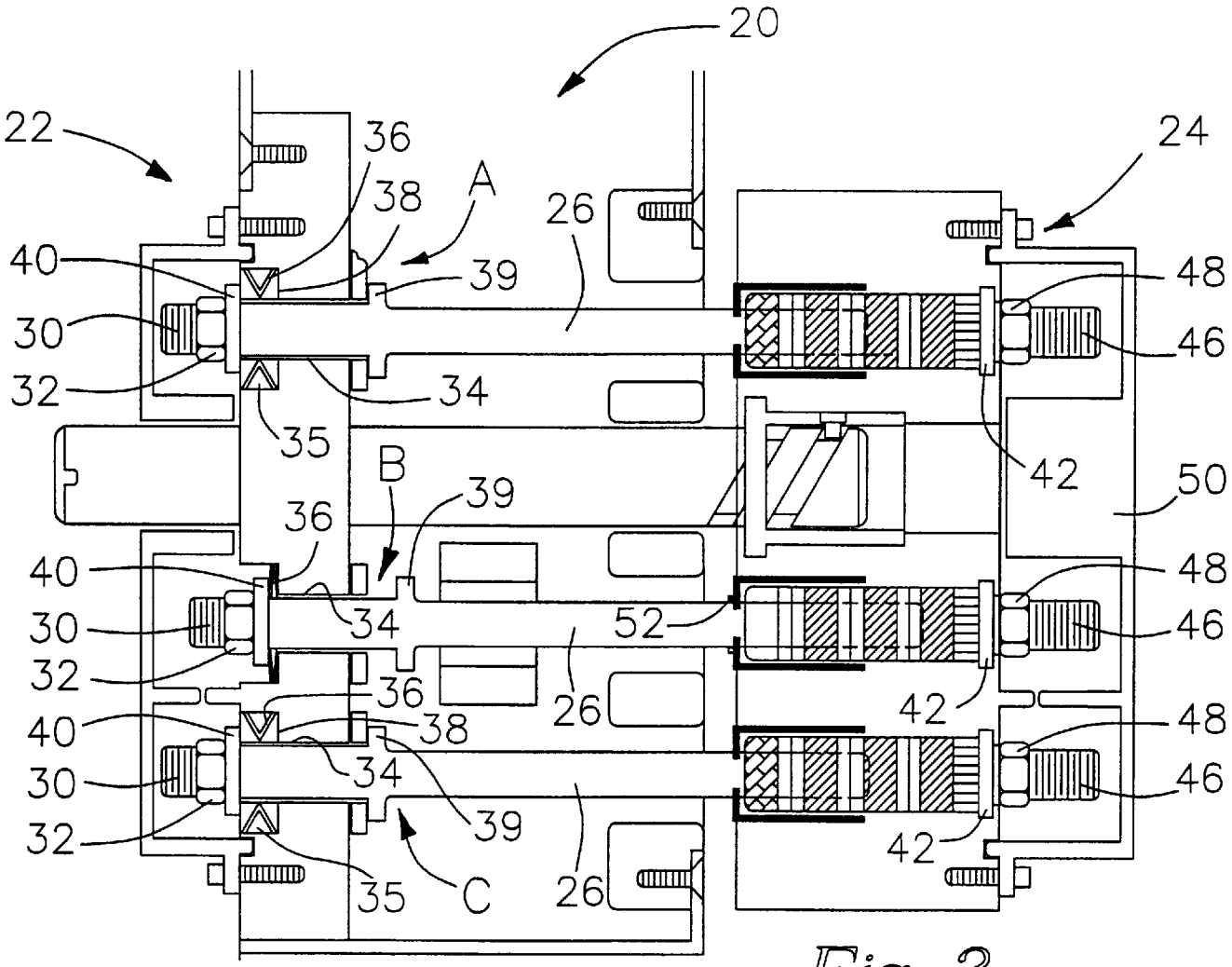
FIG. 3 is a sectional view of the preferred embodiment of the present invention in a connected and welded state, showing the compression of the spring means when disconnection is attempted but a pin and socket combination have welded together.

Turning now to the novel means by which the present invention provides a user with a visual indication that a weld between a particular pin and socket combination has occurred, it can be seen in FIGS. 1–3, that each pin 26 includes a threaded end 30 to which nut 32 is attached. Bus bar 28 includes a number of apertures 34 corresponding to the number of pins 26 through which threaded ends 30 of pins 26 can be inserted for attachment thereto. Moreover, a recess 35 is provided proximate each aperture 34 for receipt of a spring 36 therein. Spring 36 is axially confined around pin 26 by recess shoulder 38 and washer 40, which in turn is held in place by nut 32. Each pin 26 includes a flange 39 to define a back limit against which the force of nut 32 acts. Cover 41 is secured over threaded ends 30 for visibility purposes as will be described in greater detail herein.

Socket 24, of the preferred embodiment, includes a number of receptacles 42 corresponding to the number of pins 26. Each receptacle 42 includes an inner diameter corresponding to the outer diameter of pin 26 such that when plug 22 is inserted into socket 24, electrical connections between the individual pins 26 and receptacles 42 are made. Socket 24 also includes a plurality of apertures 44 into which receptacles 42 can be received. As shown in FIGS. 1–3, each receptacle 42 includes a threaded end 46 to which is secured a nut 48 for attachment of the receptacle to the socket, the importance and function of which will be described in further detail herein. Socket 24 also includes a removable cover 50 sized to enclose the individual receptacles 42.

With specific reference to FIG. 3, it can be seen that through the provision of spring 36, the user is provided with a visual indication of where a weld has occurred when plug 22 is attempted to be pulled from socket 24. In the embodiment shown in FIG. 3, two of the pins 26 (pins A and C) are not welded to receptacles 42, while one of the pins 26 (pin B) is welded to receptacle 42. Therefore, the force applied to plug 22 for removal from socket 24 attempts to remove pins 26 from receptacles 42, but is prevented from doing so as a result of weld 52.

However, as opposed to prior art systems which would simply indicate that the plug cannot be removed from the socket with no indication as to the source of the problem or the specific pin or receptacle causing the problem, the preferred embodiment of the present invention provides the user with an immediate visual indication of the source of the problem. The costly and time-consuming problem of removing and replacing the entire electrical connector and the associated cabling is therefore avoided.

The visual indication is provided to the user through the compression of spring 36 and subsequent movement of pin 26 as is visible through cover 41. In the preferred embodiment of the present invention, spring 36 is a bevel spring, but additional types of springs or biasing means can be employed provided that spring 36 is sized appropriately such that spring 36 will maintain its position when plug 22 is pulled from socket 24 and no weld exists, but will be overcome and compress when plug 22 is pulled from socket 24 and a weld does exist. As plug 22 is pulled from socket 24, the force of the pulling action against the plug will be transmitted through the pins 26 and against springs 36. Springs 36 are sized such that if a weld is not present, spring 36 will be strong enough to maintain its shape. However, if a weld is present, the pulling force will overcome the strength of the spring 36, causing the spring 36 to compress, and the threaded end of the pin 26 to recede into the recess provided in the bus bar. The user can easily see such movement and can therefore immediately recognize the welded pin and socket combination. In addition, it can be seen that flange 39 of pin B separates from bus bar 28 as well.

Figure 4:
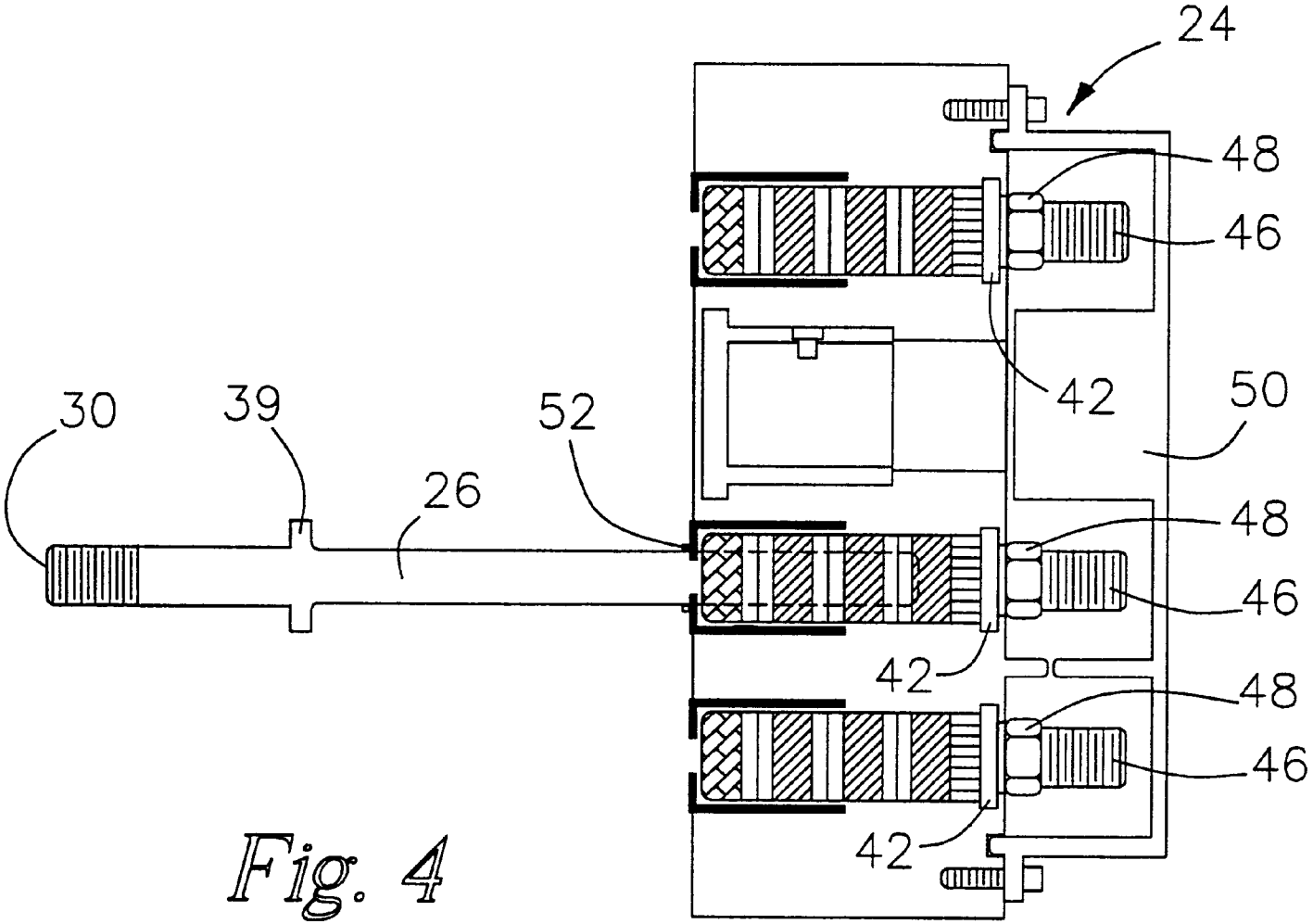
FIG. 4 is a sectional view of the preferred embodiment of the present invention after the welded pin is disconnected from the plug to allow the plug to be completely removed.

Rather than remove the entire electrical connection and cabling system, the cover 41 of plug 22 can simply be removed to allow access to nuts 32. The nut attached to the welded pin 26 can then be removed to allow the plug to be removed, leaving the welded pin attached to the socket as shown in FIG. 4. Cover 50 of socket 24 can then be removed to allow nut 48, corresponding to the appropriate receptacle 42, to be removed, and thereby allow the welded pin and socket combination to be removed and replaced. Both covers can then be replaced, and the plug can be reattached to the socket.

Figure 5:
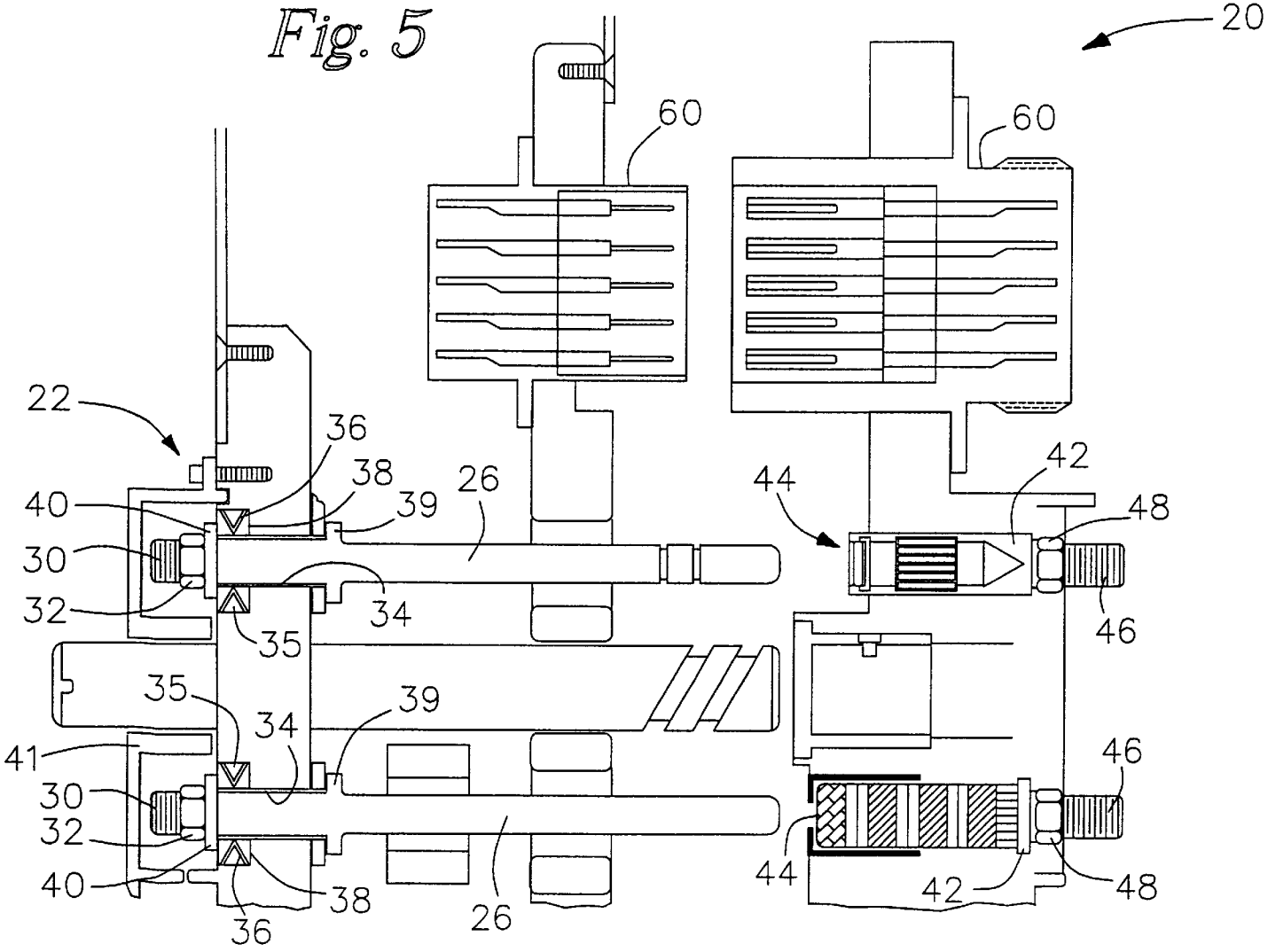
FIG. 5 is a sectional view of an alternative embodiment of the present invention which includes a power connection.

FIG. 5 shows an alternative embodiment of the present invention which further includes a signal level power electrical connection module 60. However, the actual apparatus and operation of the quick disconnect module 20 is exactly the same. The embodiment shown in FIG. 5 still includes bevel springs 36 disposed around pins 26 for compression when plug 22 is pulled from socket 24 and a weld exists. Such an embodiment therefore provides the user with a quick visual indication of when a weld exists.

It can therefore be seen by one of ordinary skill in the art, that the present invention brings to the art a new and improved electrical power connector having means for detecting when a pin and socket have become welded together. The invention therefore enables a welded pin and socket to be quickly identified and replaced while minimizing the downtime of the machine with which the pin and socket are associated. While the present invention has been described in terms of its preferred embodiment, it should be understood that numerous modifications may be made thereto without departing from the spirit and scope of the present invention. It is intended that the present invention should include not only the specific embodiments disclosed, supra, but also any embodiments equivalent thereto, reasonably taught thereby, or falling within the scope of the appended claims.

I claim:

1. An electrical power connection module, comprising:

a socket including a plurality of receptacles therein for receipt of electrical conductor pins;

a plug including a plurality of electrical conductor pins; and means for indicating when an attempt is made to remove the plug from the socket that a weld between a pin and a receptacle has occurred.

2. An electrical power connection module, comprising:

a socket including a plurality of receptacles therein for receipt of electrical conductor pins:

a plug including a plurality of electrical conductor pins; and means for indicating when a weld between a pin and a receptacle has occurred, the indicating means including a spring provided around each pin, wherein the spring is adapted to compress between a surface of the pin and the plug when the plug is attempted to be removed from the socket and a pin is welded to a receptacle.

3. The electrical power connection module of claim 2 wherein each pin includes a threaded end and a mating end, the threaded end adapted to be connected to an electrical bus bar using a washer and nut threaded onto the threaded end, the mating end adapted to be frictionally held within a socket receptacle.

4. The electrical power connection module of claim 2 further including a cover mounted over the plug to enable the indication means to be visible therethrough.

5. The electrical power connection module of claim 2 further including means for removing a welded pin and receptacle combination.

6. The electrical power connection module of claim 5 wherein the means for removing a welded pin and receptacle combination includes threaded ends on the pin and receptacle, the pin and receptacle being releasably attached to the plug and socket, respectively, by nuts attached to the threaded ends.

7. The electrical power connection module of claim 6 wherein the pin further includes a washer adjacent the nut, and a spring disposed around the pin adjacent the washer, and the plug includes a recess into which the spring is received, the spring adapted to compress and the nut and washer adapted to be received into the recess when the plug is pulled away from the socket and the pin has welded to the receptacle.

8. A method for detecting when an electrical pin and receptacle combination have become welded together, the method comprising the steps of:

pulling on a multiple pin plug matingly connected to a multiple receptacle socket, the multiple pin plug including a plurality of pins connected thereto using a spring means, each pin being individually received in a single receptacle of the socket;

viewing the spring means as the plug is attempted to be pulled from the socket and detecting a weld if the spring means compresses during the pulling step.

9. The method of claim 8 wherein the pins include a threaded end attached to the plug using a washer and a nut, the spring means being disposed around the pin between the washer and the plug.

10. The method of claim 9 further including the step of removing the nut and washer from the pin when a weld is detected to thereby allow the plug to be removed from the socket.

11. The method of claim 10 further including the step of removing the welded pin and receptacle from the socket after the plug is removed from the socket, to thereby allow a new receptacle and pin to be installed to the socket and plug, respectively.

12. In an aircraft employing a plurality of electrically powered devices, an electrical connection module for electrically connecting the electrically powered devices, comprising:

a socket including a plurality of receptacles therein for receipt of electrical conductor pins;

a plug including a plurality of electrical conductor pins; and means for indicating when an attempt is made to remove the plug from the socket that a weld between a pin and a receptacle has occurred.

13. In an aircraft employing a plurality of electrically powered devices, an electrical connection module for electrically connecting the electrically power devices comprising:

a socket including a plurality of receptacles therein for receipt of electrical conductor pins;

a plug including a plurality of electrical conductor pins; and means for indicating when a weld between a pin and receptacle has occurred, the indicating means including a spring provided around each pin, wherein the spring is adapted to compress between a surface of the pin and the plug when the plug is attempted to be removed from the socket and a pin is welded to a receptacle.

14. The electrical power connection module of claim 13 wherein each pin includes a threaded end and a mating end, the threaded end adapted to be connected to an electrical bus bar using a washer and nut threaded onto the threaded end, the mating end adapted to be frictionally held within a socket receptacle.

15. The electrical power connection module of claim 13 further including a cover mounted over the plug to enable the indication means to be visible therethrough.

16. The electrical power connection module of claim 13 further including means for removing a welded pin and receptacle combination.

17. The electrical power connection module of claim 16 wherein the means for removing a welded pin and receptacle combination includes threaded ends on the pin and receptacle, the pin and receptacle being releasably attached to the plug and socket, respectively, by nuts attached to the threaded ends.

18. The electrical power connection module of claim 17 wherein the pin further includes a washer adjacent the nut, and a spring disposed around the pin adjacent the washer, and the plug includes a recess into which the spring is received, the spring adapted to compress and the nut and washer adapted to be received into the recess when the plug is pulled away from the socket and the pin has welded to the receptacle.

* * * * *